US005692469A

United States Patent [19]

Rammer et al.

[11] Patent Number: 5,692,469

[45] Date of Patent: Dec. 2, 1997

[54] BRAKING A FOUR STROKE IC ENGINE

[75] Inventors: Franz Rammer, Wolfern; Helmut Priesner, Zwettl; Ludwig Stegmüller, Grossraming; Franz Leitenmayr, Perg, all of Austria

[73] Assignee: Steyr Nutzfahrzeuge Aktiengesellschaft, Steyr, Austria

[21] Appl. No.: 628,286

[22] Filed: Apr. 5, 1996

[30] Foreign Application Priority Data

Apr. 4, 1995 [AT] Austria ..... 597/95

[51] Int. Cl.[6] ..... F02D 13/04; F01L 13/06

[52] U.S. Cl. ..... 123/321; 123/323

[58] Field of Search ..... 123/320, 321, 123/322, 323

[56] References Cited

U.S. PATENT DOCUMENTS

| | | | |
|---|---|---|---|
| 4,662,332 | 5/1987 | Bergmann et al. | 123/323 |
| 4,848,289 | 7/1989 | Meneely | 123/323 |
| 4,856,474 | 8/1989 | Tisch | 123/323 |
| 5,086,738 | 2/1992 | Kubis et al. | 123/323 |
| 5,150,678 | 9/1992 | Wittmann et al. | 123/321 |
| 5,255,650 | 10/1993 | Faletti et al. | 123/323 |
| 5,564,385 | 10/1996 | Hakansson | 123/321 |

FOREIGN PATENT DOCUMENTS 3922884 1/1991 Germany .

*Primary Examiner*—Willis R. Wolfe

*Attorney, Agent, or Firm*—Robert W. Becker & Associates

[57] ABSTRACT

In a method for braking a four-stroke internal combustion engine having cylinders each having a combustion chamber and at least one outlet valve connected to an outlet system and controlled by an engine camshaft, wherein the outlet system comprises a choke device, the flow of exhaust gas in the outlet system is choked with the choke device such that the exhaust gas upstream of the choke device is subjected to a pressure increase. The outlet valve is opened intermediately with the pressure increase in the exhaust gas such that the exhaust gas flows back into the combustion chamber. The outlet valve is positively maintained in a part-open position with a control device, operating independently of the engine camshaft and incorporated into an outlet valve actuating mechanism, during a subsequent compression stroke of the engine for a period of time ending at the latest when the engine camshaft acts on the outlet valve in order to fully open the outlet valve.

10 Claims, 5 Drawing Sheets

$h_{max.}$
[°Kw]
A
Induction stroke
Compression stroke
Expansion stroke
Expulsion stroke
TDC
BDC
TDC
BDC
0
90
180
270
360
450
540
630
720
0
2
4
6
8
10
12
14

D
$h_{max.}$
[°Kw]
A1
A2
A3
B
C
Induction stroke
Compression stroke
Expansion stroke
Expulsion stroke
TDC
BDC
TDC
BDC
0
90
180
270
360
450
540
630
720
0
2
4
6
8
10
12
14

BRAKING A FOUR STROKE IC ENGINE

BACKGROUND OF THE INVENTION

The invention relates to a method for using a four stroke reciprocating piston engine as brake, said engine comprising for each cylinder at least one outlet valve connected with an outlet system, in which outlet system a choke means is installed, which for using the engine as a brake is so operated that the exhaust gas flow is choked and accordingly upstream from the choke means a pressure increase is produced in the exhaust gas, which after intermediate opening of the outlet valve flows back into the combustion chamber and during the following compression stroke with the outlet valve still partially open causes an increased engine braking effect. Herein the term engine braking will be used for the use of such an engine as a brake.

THE PRIOR ART

Such a method has been disclosed in the German patent publication 3,922,884 C2. In this case a cam shaft operated outlet valve is arranged to be driven by way of a piston forming part of the valve operating mechanism, such piston being arranged to be acted upon by a specifically provided hydraulic pump unit for engine braking. This hydraulic pump unit comprises pump pistons equal in number to the number of outlet valves of the internal combustion engine and furthermore a timing cam rotating synchronously with the cam drive for the operation of the pump pistons. Furthermore the outlet system has an choke device installed therein, which is so operated for engine braking that at least a part of the exhaust gas flow is choked and upstream from the choke device an increase in the pressure of the exhaust gas is produced. A key criterion of this known engine braking system is that the cam operating the pump pistons of the hydraulic pump unit is so shaped that each outlet valve is opened by its piston in the valve drive in a range equal to 180°±40° of the crank angle preceding ignition top dead center and is closed again in a range of 40°±40° of the crank angle after ignition dead center, see in this respect the chart in FIG. 2. This means that although there is a very high engine braking effect, this is at the cost of an extremely expensive additional system (hydraulic pump unit, associated control lines, drive piston in the outlet valve drive), which costs are subject to a corresponding increase with every additional cylinder in the engine.

SHORT SUMMARY OF THE INVENTION

Taking this state of the art into account, one object of the invention is to provide a method of engine braking with a four stroke reciprocating piston internal combustion engine, which produces a comparably efficient engine braking effect with a substantially reduced outlay as regards components and costs.

In order to achieve these and/or other objects appearing from the present specification, claims and drawings, in the present invention a method of using a four stroke reciprocating piston engine as a brake, said engine comprising for each cylinder comprises at least one outlet valve connected with an outlet system, in which outlet system a choke means is installed, which for engine braking is so operated that the exhaust gas flow is choked and accordingly upstream from the choke means a pressure increase is produced in the exhaust gas, which after intermediate opening of the outlet valve flows back into the combustion chamber and during the following compression stroke with the outlet valve still partially open causes an increased engine braking effect, is characterized in that during engine braking intermediate opening of the outlet valve is caused by a pressure increase in the exhaust gas with the choke device in the choking position, and such intermediate opening is modified by a control technique such that the outlet valve, which after such intermediate opening tends to close, is positively caught by a control device independent of the cam shaft in the outlet valve timing mechanism, is prevented from closing and then is held partly open at the longest until the outlet valve is opened by the cam shaft.

The inventive method for braking a four-stroke internal combustion engine having cylinders each having a combustion chamber and at least one outlet valve connected to an outlet system and controlled by an engine camshaft, wherein the outlet system comprises a choke device, is primarily characterized by the following steps:

- choking with the choke device the flow of exhaust gas in the outlet system such that the exhaust gas upstream of the choke device is subjected to a pressure increase;
- opening intermediately the outlet valve with the pressure increase in the exhaust gas such that the exhaust gas flows back into the combustion chamber;
- positively maintaining the outlet valve in a part-open position with a control device, operating independently of the engine camshaft and incorporated into an outlet valve actuating mechanism, during a subsequent compression stroke of the engine for a period of time ending at the latest when the engine camshaft acts on the outlet valve in order to fully open the outlet valve.

The step of positively maintaining includes hydraulically locking the control device as a buffer, and the method further comprises the step of cancelling the hydraulic locking action of the control device, when the engine camshaft acts on the outlet valve in order to open the outlet valve, such that the control device functions simply as a mechanical buffer and the camshaft controls the outlet valve via the outlet valve actuating mechanism to perform a full opening stroke, to reside in the open position, and to perform a subsequent closing stroke during the expulsion stroke.

The method further comprises the step of mounting the control device in a bore of a rocker lever positioned at the cylinder head. The control device is comprised of:

- a drive piston with a first and a second end, supported in a fluid-tight manner in the bore of the rocker lever so as to be moveable between an outer and an inner end position delimited by limiting abutments and acting with a first end onto a rearward end surface of the outlet valve shank;
- a control bushing threaded into the bore and having a pressure space opening toward the drive piston and a fluid supply duct opening into the pressure space for feeding a pressure fluid into the pressure space for hydraulically loading the second end of the drive piston;
- a spring positioned in the pressure space for loading the second end of the drive piston;
- a feed duct extending within the rocker lever and opening into the fluid supply duct;
- a check valve with a spring-loaded closure means for preventing flow of the pressure fluid from the pressure space back into the fluid supply duct;
- a relief duct extending from the pressure space through the control bushing to a remote end thereof remote from the pressure space; and a closure abutment for closing off the relief duct at the remote end for building and maintaining fluid pressure within the pressure space during the step of positively maintaining the outlet valve in the part-open position for moving the drive piston with the first end toward the rearward end surface into the outer end position and maintaining the drive piston in the outer end position.

During the step of intermediately opening, due to the forces acting within the pressure space, the drive piston moves toward the rearward end surface, following a movement of the outlet valve shank, into the outer end position and the pressure space is filled with pressure fluid such that the drive piston is hydraulically locked in the outer end position so as to secure with the first end the outlet valve shank, when moving toward a closed position of the outlet valve, in the part-open position.

The method further includes the step of returning the drive piston from the outer end position into the inner end position by actuating the rocker lever via the camshaft such that the rocker lever is moved away from the closure abutment, the relief duct is opened, and the pressure fluid is released from the pressure space so that the drive piston can return into the inner end position.

The method may further include the step of using the control device as a hydraulic valve play compensation device wherein a play occurring within the outlet valve actuating mechanism is compensated by filling the pressure space with pressure fluid and thereby moving the drive piston in direction toward the outlet valve.

Preferably, the camshaft is positioned below the engine and the outlet valves are actuated via tappet rods and rocker levers, further comprising the step of mounting the control device between the tappet rod and the rocker lever in a receiving sleeve of the cylinder head, wherein the control device is comprised of:

a control sleeve positioned in a fluid-tight manner within the receiving sleeve so as to be coaxially moveable from a first retracted position into a second extended position, the control sleeve having a bottom end resting on the tappet rod and a top end facing the rocker lever;

the control sleeve having a blind hole opening toward the rocker lever;

a drive piston with a first and a second end positioned in a fluid-tight manner in the blind hole so as to be coaxially moveable into an inner and an outer end position;

the rocker lever having a force-transmitting means and a thrust transmitting part pivotably connected to the force transmitting means;

the drive piston resting with a first end at the thrust transmitting part and delimiting with the second end a pressure space within the blind hole;

a spring positioned in the pressure space so as to bias the drive piston against the thrust transmitting part;

a fluid supply duct opening into the pressure space for feeding a pressure fluid into the pressure space for hydraulically loading the second end of the drive piston;

a feed duct extending within the cylinder head and opening into the fluid supply duct;

a check valve with a spring-loaded closure means for preventing flow of the pressure fluid from the pressure space back into the fluid supply duct.

The drive piston has a relief duct communicating with the pressure space, the first relief duct closed off in the inner end position by the inner wall of the blind hole, wherein during the step of intermediately opening the drive piston, due to the forces acting within the pressure space, moves into the outer end position and pushes the rocker arm upwardly, whereby a stroke of the drive piston into the outer end position is selected according to the intermediate lifting stroke of the outlet valve and wherein in the outer end position the first relief duct is no longer closed off by the inner wall of the blind hole and the fluid pressure within the pressure space is released via the first relief duct, wherein, when the outlet valve begins to close, the rocker lever is moved in direction toward the drive piston and the drive piston is returned by the thrust transmitting part so that the first relief duct is closed off allowing the fluid pressure to build within the pressure space to thereby hydraulically lock the control device and maintain the outlet valve in the pad-open position.

The control sleeve has a second relief duct communicating with the pressure space, the second relief duct closed off by the inner wall of the receiving sleeve in the first retracted position, wherein the step of cancelling the hydraulic locking action of the control device, when the engine camshaft acts on the outlet valve in order to open the outlet valve, includes pushing with the tappet rod the control sleeve by a stroke selected according to a maximum opening stroke of the outlet valve such that the second relief duct is no longer closed off by the inner wall of the receiving sleeve and the pressure fluid is released from the pressure space, thereby causing the drive piston to return into the inner end position in which the thrust transmitting part rests flush at an end face of the control sleeve.

The method advantageously further includes the step of using the control device as a hydraulic valve play compensation device wherein a play occurring within the outlet valve actuating mechanism is compensated by filling the pressure space with pressure fluid and thereby moving the drive piston in direction toward the outlet valve.

In the part-open position the outlet valve has travelled from a closed position by a stroke of 1/5 to 1/20 of the full opening stroke.

The invention in this respect takes as its starting point the following process of reasoning: An excessively high price is paid for the desired engine braking effect provided by the system in accordance with the above mentioned German patent publication 3,922,884 C2. If the additional means necessary therein for engine braking are omitted and if in the outlet system only a conventional choking device is provided, with which during engine braking at least a part of the exhaust gas current is choked in the exhaust gas system with the concomitant production of a pressure increase upstream from the choke device, the engine braking action which can then be achieved is insufficient for many applications, more particularly if the internal combustion engine is installed in a motor vehicle such as a truck or an omnibus. It has now been seen that in the case of such internal combustion engines equipped only with a conventional choke device in the exhaust gas system, if the outlet valve closing springs are only moderately stiff to reduce the spring forces and accordingly to facilitate valve operation, during engine braking the pressure increase due to the choke device set for choking in the exhaust gas current generally causes a transient intermediate opening of the outlet valve just at that moment, at which the piston is near bdc during the induction stroke. The point in time of opening is dependent on the number of cylinders and the engine type (V or in-line engine) and occurs automatically independently from cam shaft timing and although it causes a transient reverse flow of the of exhaust gas into the combustion space with the consequence of a marginal increase in the engine braking effect, this takes place at the expense of disadvantageous effects in the valve drive, because the outlet valve is lifted from its seat for intermediate opening and on return into the closing position crashes against the seat, something which is a cause of noticeable increase in wear and involves the danger of the valve plate being torn off. This intermediate opening of the outlet valve due to the opposing exhaust gas pressure is now modified by the present invention, inter alia to solve the above mentioned problem, using a comparatively simple and inexpensively produced control device, which incorporated in and, respectively, combined with the method of the invention leads to an engine braking effect equal to that of the said German patent publication 3,922,884 C2. In this respect the advantages of a partial holding open of the outlet valve for the entire compression stroke and approximately 40° to 50° after ignition tdc have been disclosed in the last named publication. As regards the further partial holding open of the outlet valve in the caught position in accordance with the invention in the expansion stroke it is to be borne in mind that up till the time at which the combustion space pressure becomes less than the exhaust gas counter-pressure, partial holding open will increase the engine braking effect. As from this point in time, occurring in the expansion stroke approximately 40° to 60° after ignition tdc, during engine braking exhaust gas will issue from the exhaust gas system back into the cylinder where it will increase the cylinder pressure, something which will initially somewhat reduce the braking effect. However this greater charging of the cylinder will take effect in the following expulsion stroke again and cause a greater engine braking effect. To this extent the comparatively cheap and simply realized control device of the invention, which can be installed in already existing engines, renders it possible to employ the method of the invention to lead to the result of a comparatively intensive engine braking action.

In what follows the design in accordance with the invention will be described in more detail with reference to the accompanying drawings.

LIST OF THE SEVERAL VIEWS OF THE FIGURES

Figure 2:
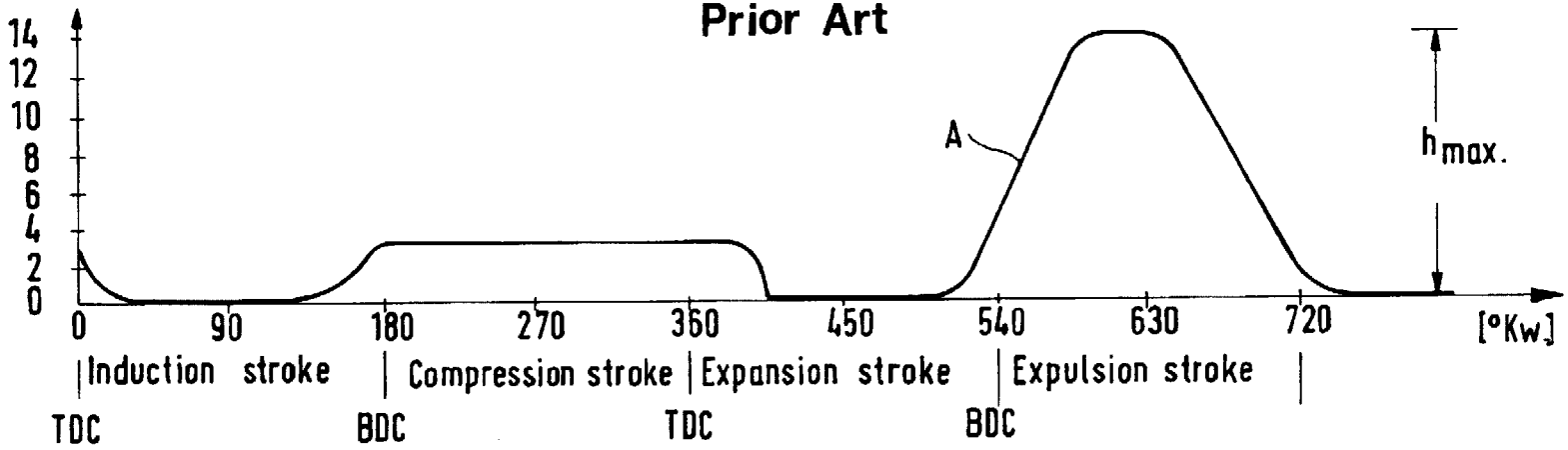
FIG. 2 Prior Art
FIG. 2 is a chart to indicate the stroke movements of an outlet valve during braking operation using the known braking method of the said German patent publication 3,922,884 C2.

FIGS. 3A–3D respectively show a portion of an outlet valve operating mechanism with a control device in accordance with a first embodiment of the invention in an operating setting during braking operation in accordance with the invention.

FIGS. 4A–4D respectively show a portion of another outlet valve operating mechanism with a second embodiment of a control device in accordance with the invention in one operating setting during braking operation in accordance with the invention in the course of braking.

DETAILED ACCOUNT OF WORKING EMBODIMENTS OF THE INVENTION

In FIGS. 3A through 3D and 4A through 4D like parts are denoted by like reference characters.

In the figures in relating to a four stroke reciprocating piston internal combustion engine only the shank of an outlet valve 1 and the associated valve operating mechanism is to be seen to the extent that this is required for comprehension of the present invention.

Basically this four stroke reciprocating piston internal combustion engine comprises only one outlet valve per cylinder connected with an outlet system. The outlet valves are timed or driven by a conventional cam shaft for changing gases by way of suitable valve operating mechanisms. In conjunction with the outlet valve there is a rocker lever 3 pivotally mounted in the cylinder head 2, in accordance with the respective arrangement of the cam shaft on the engine for direct operation or indirect operation via a tappet rod 4. The outlet valve 1, whose shank runs in the cylinder head, is constantly acted upon by a closing spring permanently acting in the closing direction. A choke device, for instance in the form of a choke flap, is incorporated in the outlet system and is so operated by way of suitable control means for engine braking that the flow of exhaust gas is choked and upstream from the choke device an increase in pressure is produced in the exhaust gas. The pressure waves resulting from expulsion from adjacent cylinders are superimposed on one another with the stationary counter-pressure and owing to the positive pressure difference cause an intermediate opening of the outlet valve 1—see phase A1 in the chart of FIG. 1. This intermediate opening of the outlet valve occurring independently of the timing action of the cam shaft is modified, during braking operation, by the control technique of the invention, since the outlet valve 1, which after such intermediate opening tends to close under the action of the closing spring, is positively caught by a control device 5 independent from the cam shaft in the outlet valve timing mechanism, and is then held by means of such control device 5 for the entire compression stroke and also the expansion stroke in a partly opened caught position—see phase A2 in the chart of FIG. 1.

The control device 5 may be constructed in various different manners and be placed at different positions in the outlet valve operating mechanism Examples thereof are shown in FIGS. 3A through 3D and 4A through 4D.

In the example in accordance with FIGS. 3A through 3D the control device 5 is placed in the rocker lever 3 for action therein and comprises two main means, namely a drive piston 6 and a control bushing 7. The drive piston 6 runs in a hole or bore 8 in the rocker lever (rocker arm) 3 with minimum leakage axially between two terminal positions set by two limiting abutments 9 and 10, acts at the front via a curved end surface 11 on the rear end surface 12 of the outlet valve shank and at the rear is acted upon by a compression spring 13 and may also be acted upon by hydraulic pressure.

The control bushing 7 is screwed into a screw threaded portion of the same hole 8 in the rocker lever 3 over the drive piston 6 and its front end constitutes the rear abutment 9, which defines the retracted, basic position of the drive piston 6. The extended or projecting end position of the drive piston 6 is delimited by the front abutment 10, which is constituted by the rear edge of a peripheral groove in the drive piston 6, into which a stroke delimiting means 14 fits, which is secured to the rocker lever 3.

The control bushing 7 has a pressure space 15 which is open to the front toward the drive piston 6, into which pressure space firstly the compression spring 13, which acts on the drive piston 6, and secondly a check valve (having a closing member 17 loaded by a compression spring) which only permits the introduction of fluid under pressure from a fluid supply duct 16, are fitted. The fluid supply duct 16 which comprises a transverse hole and a further hole extending therefrom and opening (within the control bushing) centrally into the pressure space 15, is supplied via a feed duct 18, placed within the rocker lever, from the bearing region 19 of the rocker lever, with fluid under pressure, in the present case lubricating oil at a predetermined pressure. Moreover a relief duct 20 extends from the pressure space 15 through the control bushing 7 and through an insert 19 fixedly mounted therein, the exit opening at the insert of such relief duct being held closed during a braking operation in the catching and holding phase (A2) of the control device 5 for the purpose of building up and holding the fluid pressure in the pressure space 15 and of outward extension and holding, occurring therewith, of the drive piston 6 in the extended outlet valve catching position (outer end position), by means of an abutment 22 fixedly arranged on the cylinder end member or structure 21.

In what follows a complete cycle of engine braking will be reviewed with reference to the series of FIGS. 3A, 3B, 3C and 3D.

Figure 3A:
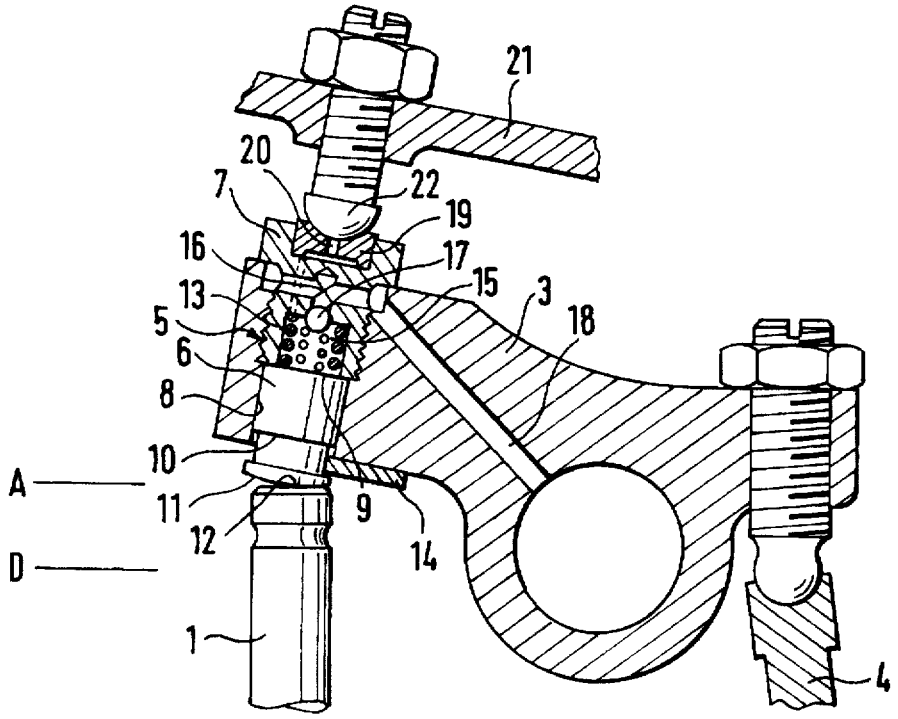

In this respect FIG. 3A shows the outlet valve 1 at the commencement of an induction stroke (intake stroke) in the closed setting A. In this phase the control device 5 within the rocker lever 3 acts as a mechanical buffer, the drive piston 6 being urged from below by the outlet valve 1 into the retracted setting (inner end position) and the control bushing 7 is supported via its insert 19 against the closure abutment 22. Any valve play present will be taken up by partial outward movement or extension of the drive piston 6.

Figure 1:
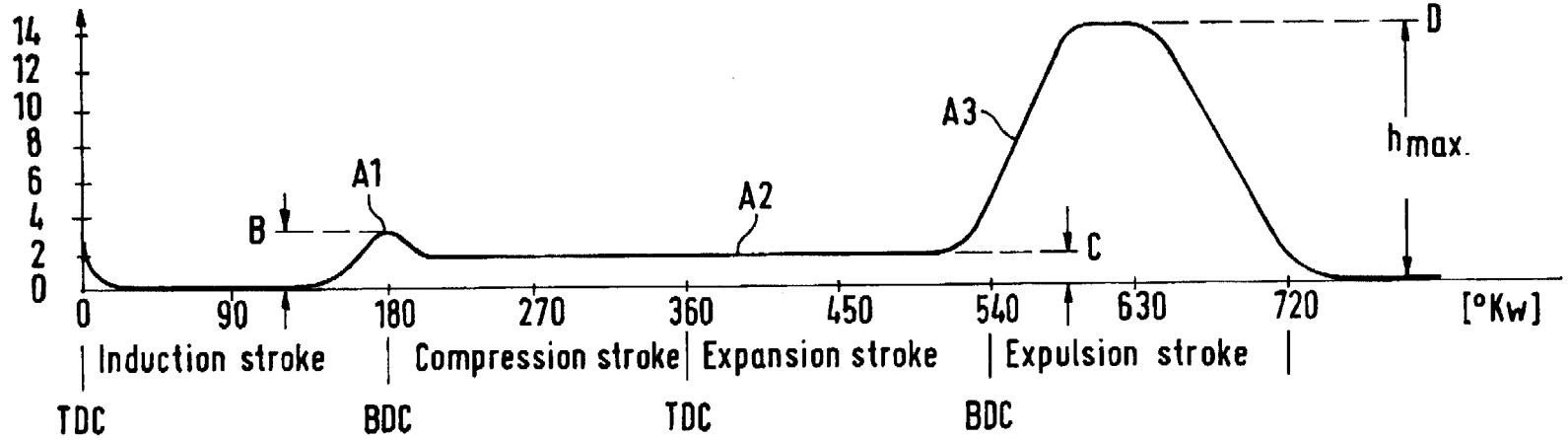
FIG. 1 shows a chart to indicate the stroke movements of an outlet valve during braking operation using the braking method of the invention.
Figure 3B:
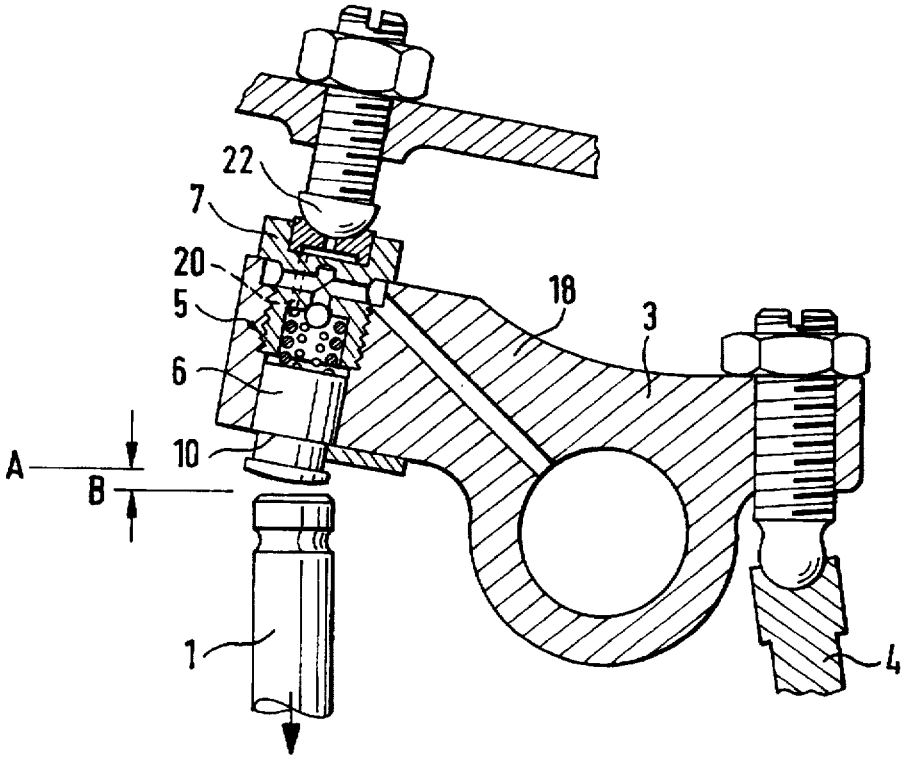

FIG. 3B shows the situation at this instant, when the outlet valve 1 has performed its maximum stroke B, during engine braking accompanied by intermediate opening, due to the exhaust gas counter-pressure, in the phase A1 (see chart of FIG. 1). In such intermediate opening of the outlet valve 1 same is lifted clear of the drive piston 6 and the latter is now caused to move by the compression spring 13 into its catching position. This is accompanied, because the drive piston 6 is moved away from the control bushing 7, by an increase in size of the pressure space 15 and by filling thereof with fluid via the fluid supply duct 16, in which respect after complete filling of the pressure space 15, on the one hand owing to the obstructing check valve 17 and on the other hand owing to the shut exit opening of the relief duct 20, the drive piston 16 is locked hydraulically in its extended catching position (preset by the abutment 10). This situation is indicated in FIG. 3B. FIG. 3B furthermore serves to indicate that during intermediate opening the outlet valve 1 is ahead of this drive piston with a large stroke of A–B.

Figure 3C:
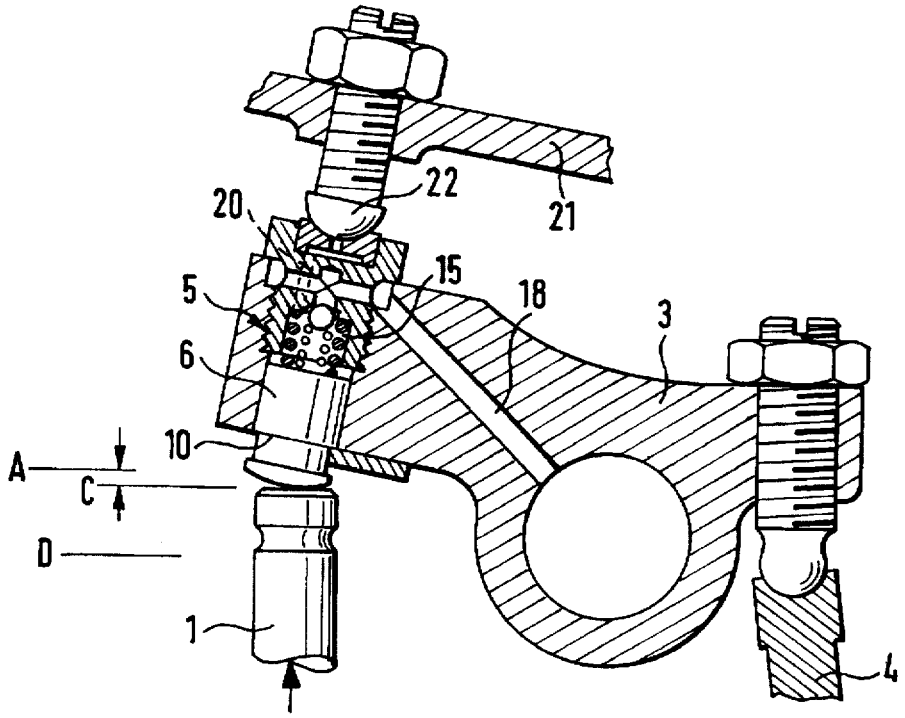
Figure 3D:
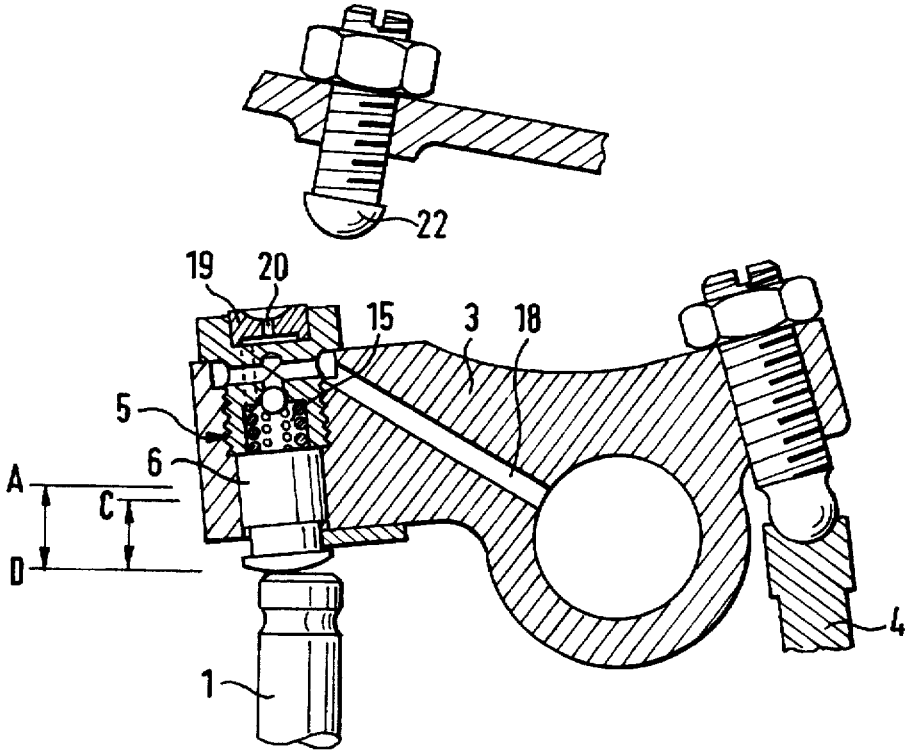

On the transition from phase A1 to phase A2 the outlet valve 1 will again move in the closing direction, but then after only a short displacement or stroke of B–C it will be caught by the hydraulically obstructed control device 5. FIG. 3C shows this catching position C with the state of the system otherwise unchanged as in FIG. 3B, such catching position C being maintained for the full remainder of the compression stroke and the following expansion stroke.

It is only when at the end of the expansion stroke the cam shaft timing action for the outlet valve 1 again exerts its effect via the associated outlet cam, that this previous hydraulic obstruction of the control device 5 is overridden, for, as soon as the rocker lever 3 is moved toward the "outlet valve open" position, the control bushing 7 together with its insert 19 is lifted clear of the abutment 22. This means that the relief duct 20 is cleared and fluid may now flow out from the pressure space 15 of the control device 5, which is now no longer obstructed, under the action of the drive piston 6 urged by the outlet valve 1 toward its retracted, basic position.

As soon as the drive piston 6 is fully retracted, the control device 5 will again act as a purely mechanical buffer on the rocker lever 3, via which then in phase A3 (see the chart of FIG. 1) in the course of the expulsion stroke exhaust stroke in engine braking the following take place: the opening of the outlet valve 1 as far as the full outlet valve stroke D (the position shown in FIG. 3D), the holding and renewed closure thereof (as controlled by the associated outlet timing cam on the cam shaft).

At the end of the expulsion stroke during engine braking the rocker lever 3 resumes, together with the control device 5, the position illustrated in FIG. 3A, ready for the next braking cycle.

The design of the control device in accordance with FIGS. 4A through 4D is employed in a four stroke internal combustion engine, whose side cam shaft serves to operate an outlet valve 1 via its tappet rod 4 and a following rocker lever 3. In this case the control device 5 of the invention is accommodated in the space between the tappet rod 4 and the force transmitting means 23 of the rocker lever 3. This control device 5 is installed in a receiving sleeve 24, same being screwed into a screw threaded hole 25 in the cylinder head 2 or a block fitted externally thereto. In the through hole 26 in the receiving sleeve 24 a control sleeve 27 runs coaxially with minimum leakage, it being supported below on the top end of the tappet rod 4. The control sleeve 27 possesses a blind hole bore 28, in which a drive piston 29 runs with minimum leakage for coaxial motion. The same bears at the top on a thrust transmitting part 30, connected articulatingly with the force transmitting means 23 of the rocker lever 3, and at the bottom is acted upon by compression spring 31 toward the latter. This compression spring 31 is fitted in the part, present underneath the drive piston 29, of the blind hole 28 and in this case pressure space 32 so delimited. The latter is supplied via a feed duct within the cylinder head or, respectively, the block and via a feed duct 34 within the receiving sleeve and furthermore a supply duct 33, placed within the control sleeve and communicating with the duct 34, with fluid under pressure, more particularly engine oil at a predetermined pressure level. In this respect the closing member 36 of a check valve fitted in the pressure space 32 prevents return flow of fluid from the pressure space 32 into the supply duct 35.

In what follows an account will be provided of a complete cycle of engine braking using such control device 5 with reference to the series of FIGS. 4A, 4B, 4C and 4D.

Figure 4A:
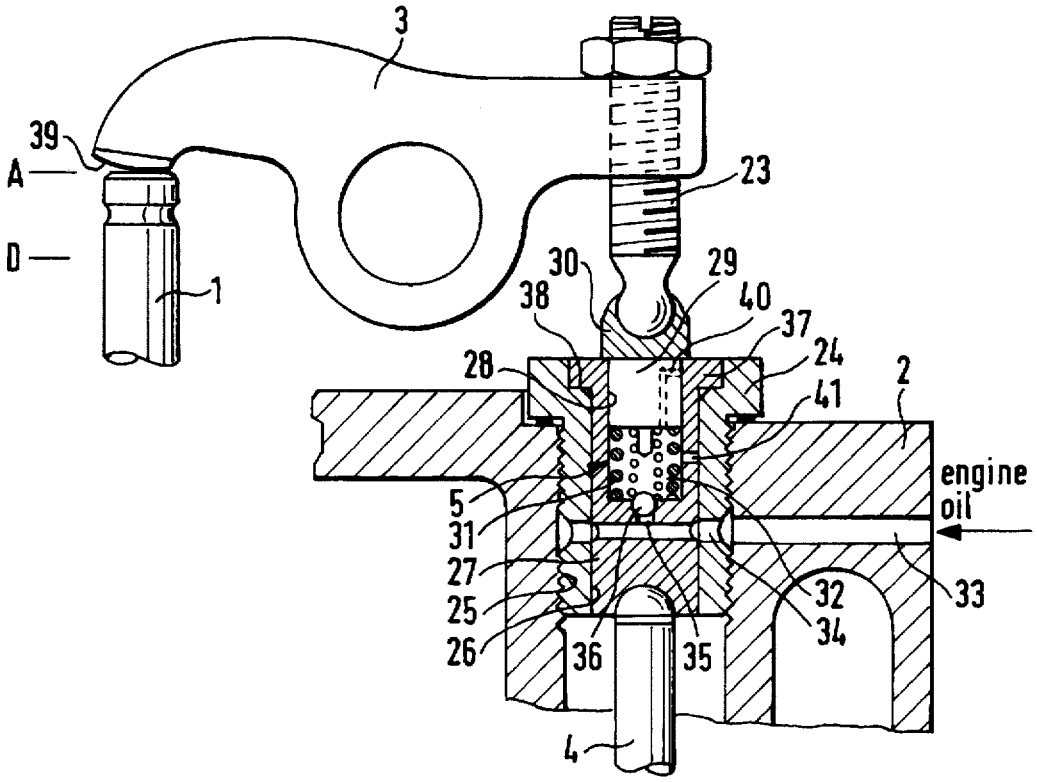

In this respect FIG. 4A shows the outlet valve 1 at the start of an induction stroke in the closed setting A. The parts 27 and 29, placed within the receiving sleeve 24, of the control device 5 then act as a mechanical buffer, the drive piston 29 being urged by the thrust transmitting part 30, connected with the rocker lever 3, into the retracted position while the control sleeve 27 at its collar 37 is urged against an abutment surface 38 on the receiving sleeve. Any valve play present will be taken up by partial extension or outward motion of the control piston 29.

Figure 4B:
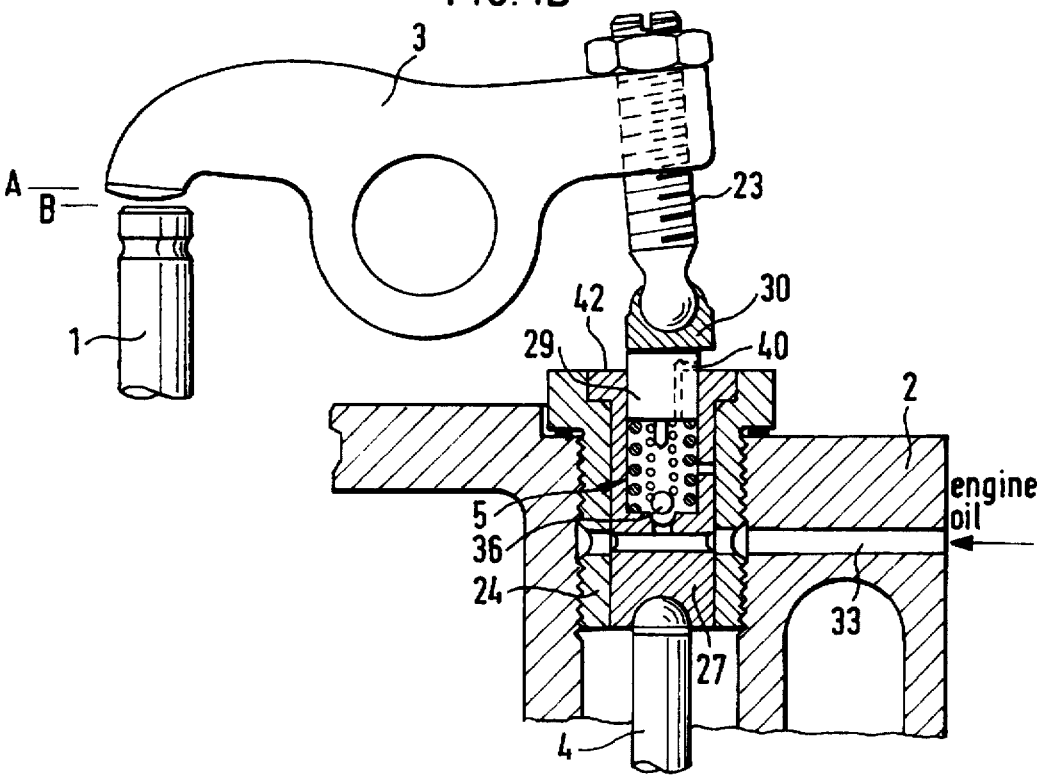
Figure 4C:
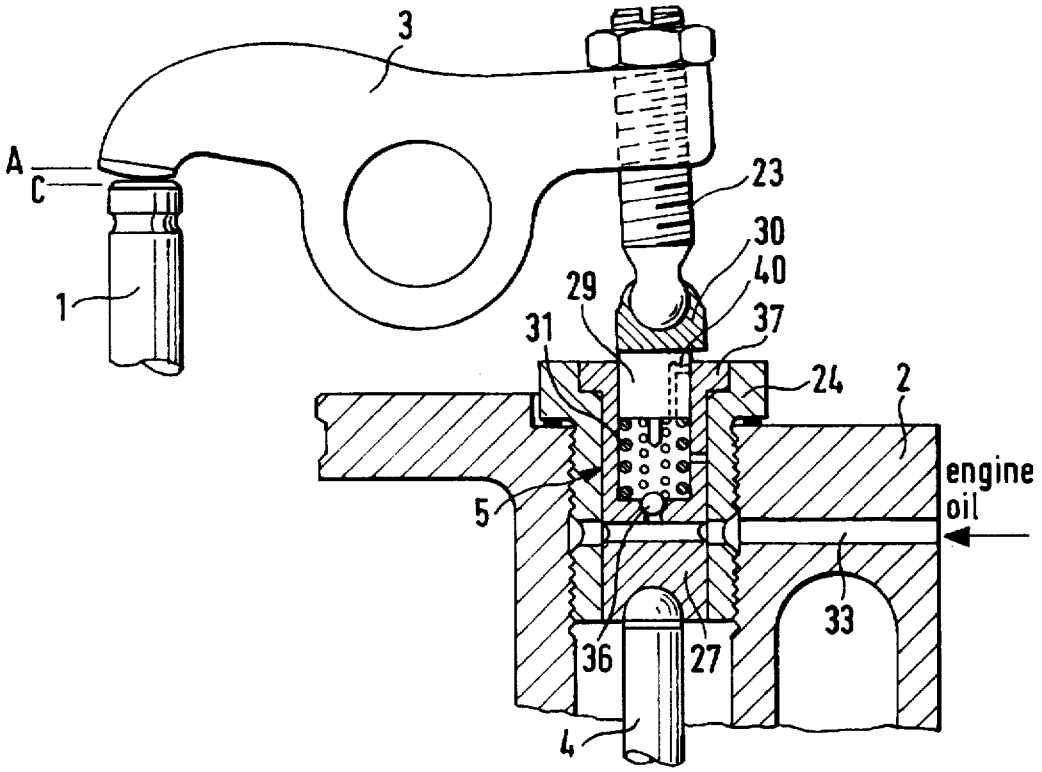
Figure 4D:
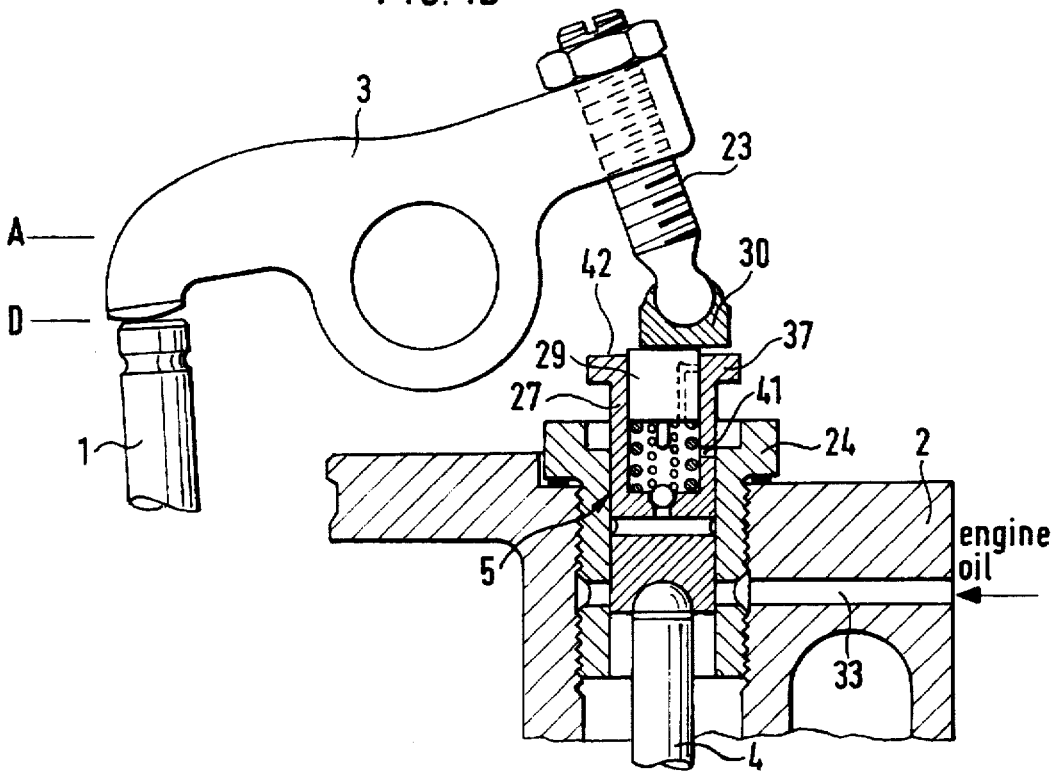

FIG. 4B shows the situation at the instant, when the outlet valve 1 has performed its maximum stroke B, during engine braking, in phase A1 (see the chart of FIG. 1), there being an intermediate opening owing to the counter-pressure of the exhaust gas. During such intermediate opening of the outlet valve 1 such valve will be lifted clear of the abutting surface 39 on the rocker lever 3 and owing to the forces acting on it in the pressure space 32 the rocker lever 3 will be moved to keep up with the outwardly moving drive piston 29. Such outward movement of the drive piston 29 means that after a stroke displacement set to match the upward movement A–B of the outlet valve 1, the exit opening of a relief duct 40 within the drive piston is cleared by leaving the blind hole 28 inside the control sleeve and the fluid within the pressure space is relieved of pressure. This outward motion of the drive piston 29 means that there is an enlargement of the pressure space's volume, which is filled by the introduction of fluid from the supply duct 35.

At the start of the following closure movement of the outlet valve 1 on transition from phase A1 to phase A2, by means of the rocker lever 3, which is caused to keep in step, and the thrust transmitting part 30 the drive piston 29 is displaced back toward its non-extended basic setting until the exit opening of the relief duct 40 is just closed again by the wall of the blind hole 28 present within the control sleeve. Accordingly the pressure space 32 is shut off again, the control device 5 is hydraulically locked and the outlet valve 1 remains in this position corresponding to the partially opened position C in which it is caught. This situation will be seen in figure 4C. The catching position C of the outlet valve then assumed will be maintained for all the rest of the compression stroke and the following expansion stroke.

At the end of the expansion stroke and during the following expulsion stroke the cam shaft action on the outlet valve 1 will again take effect via the respective outlet valve cam, the outlet valve 1 being moved toward its maximum opening position D by way of the following: the tappet rod 4, the control sleeve 27 with the drive piston 29 still hydraulically obstructed or locked, the thrust transmitting means 30 and the rocker lever 3. After a certain stroke, set to match the maximum opening stroke A–D of the outlet valve 1, of the control sleeve 27, owing to the emergence of same from the receiving hole 36 in the receiving sleeve 24 the exit cross section of a relief hole 41 extending transversely from the pressure space 32 is cleared—something depicted in FIG. 4D—so that the hydraulic locking of the drive piston 29 is discontinued, for the fluid present in the pressure space 32 is relieved of pressure via the relief hole 41 to the outside and is reduced in volume as well by the following up drive piston 29 until the drive piston 29 has assumed its completely retracted, basic position, which is defined by engagement of the thrust transmitting part 30 against the end side 42 of the control sleeve 27.

As soon as the control piston 29 is completely retracted, the control device 5 will resume its function of a purely mechanical buffer between the tappet rod 4 and the thrust transmitting part 30 on the rocker lever 3, via which in the phase A3 (see chart of FIG. 1) during the expulsion stroke in engine braking the dwell in the open position D and renewed closure of the outlet valve 1 is caused to take place by the outlet cam of the cam shaft. On closing of the outlet valve 1 the control sleeve 27 is urged back into the receiving sleeve 24 till it abuts, the relief hole 41 being closed again so that the pressure space 32 is shut off again.

At the end of the expulsion stroke during engine braking the outlet valve 1, the rocker lever 3 and the control sleeve 27 of the control device 5 resume the position depicted in FIG. 4A ready for the next braking cycle.

The control device 5 is so designed that the outlet valve 1 is held, after intermediate opening due to the exhaust gas counter-pressure, in a catching position C, whose distance from the closed position amounts to approximately 1/5 to 1/20 of the full outlet valve opening stroke A–D dictated by the cam shaft.

The control device 5 does however also possess the general advantage that in addition to its function as described, it is also to be employed as a valve play compensating means. In this case the compensation for valve play takes place on the occurrence of play in the valve operation mechanism by suitable topping up of fluid in the pressure space 15 or, respectively, 32 of the control device 5 with a suitable follow-up movement of the control piston 6 or, respectively, 29 toward the means 1 or, respectively, 30 to be acted upon.

The present invention is, of course, in no way restricted to the specific disclosure of the specification and drawings, but also encompasses any modifications within the scope of the appended claims.

We claim:

1. A method for braking a four-stroke internal combustion engine having cylinders each having a combustion chamber and at least one outlet valve connected to an outlet system and controlled by an engine camshaft, wherein the outlet system comprises a choke device, said method comprising the steps of:

choking with said choke device the flow of exhaust gas in the outlet system such that, during the induction stroke of the engine, the exhaust gas upstream of said choke device is subjected to a pressure increase causing an intermediate opening of said outlet valve and back-flow of exhaust gas into the combustion chamber;

preventing of complete closing of said outlet valve by positively maintaining said outlet valve in a part-open position with a control device, operating independently of the engine camshaft and incorporated into an outlet valve actuating mechanism, for a period of time during a subsequent compression stroke and expansion stroke of the engine and ending at the latest when the engine camshaft acts on said outlet valve in order to fully open said outlet valve, wherein said step of positively maintaining includes hydraulically locking said control device for subsequently acting as a hydraulically locked buffer;

cancelling the hydraulic locking action of said control device at the end of the expansion stroke of the engine, when the engine camshaft acts on said outlet valve in order to open said outlet valve, such that during the subsequent expulsion stroke of the engine the full opening stroke, the residence in the open position, and the subsequent closing stroke of said outlet valve are controlled by the camshaft and said outlet valve actuating mechanism, while said control device, now unlocked, functions simply as a mechanical buffer.

2. A method according to claim 1, wherein in said part-open position said outlet valve has travelled from a closed position by a stroke of 1/5 to 1/20 of said full opening stroke.

3. A method according to claim 1, wherein the camshaft is positioned below the engine and said outlet valves are actuated via tappet rods and rocker levers, further comprising the step of mounting said control device between said tappet rod and said rocker lever in a receiving sleeve of the cylinder head, wherein said control device is comprised of:

a control sleeve positioned in a fluid-tight manner within said receiving sleeve so as to be coaxially moveable from a first retracted position into a second extended position, said control sleeve having a bottom end resting on said tappet rod and a top end facing said rocker lever;

said control sleeve having a blind hole opening toward said rocker lever;

a drive piston with a first and a second end positioned in a fluid-tight manner in said blind hole so as to be coaxially moveable into an inner and an outer end position;

said rocker lever having a force-transmitting means and a thrust transmitting part pivotably connected to said force transmitting means;

said drive piston resting with a first end at said thrust transmitting part and delimiting with said second end a pressure space within said blind hole;

a spring positioned in said pressure space so as to bias said drive piston against said thrust transmitting part;

a fluid supply duct opening into said pressure space for feeding a pressure fluid into said pressure space for hydraulically loading said second end of the drive piston;

a feed duct extending within the cylinder head and opening into the fluid supply duct;

a check valve with a spring-loaded closure means for preventing flow of the pressure fluid from the pressure space back into the fluid supply duct.

4. A method according to claim 3, further including the step of using said control device as a hydraulic valve play compensation device wherein a play occurring within said outlet valve actuating mechanism is compensated by filling said pressure space with pressure fluid and thereby moving said drive piston in direction toward said outlet valve.

5. A method according to claim 3, wherein said drive piston has a first relief duct communicating with said pressure space, said first relief duct closed off in said inner end position by the inner wall of said blind hole, wherein during said step of intermediately opening, due to the forces acting within said pressure space, said drive piston moves into said outer end position and pushes said rocker arm upwardly, whereby a stroke of said drive piston into said outer end position is selected according to the intermediate lifting stroke of said outlet valve and wherein in said outer end position said first relief duct is no longer closed off by the inner wall of said blind hole and fluid pressure is released via said first relief duct, wherein, when said outlet valve begins to close, said rocker lever is moved in direction toward said drive piston and said drive piston is returned by said thrust transmitting part so that said first relief duct is closed off allowing the fluid pressure to build within said pressure space to thereby hydraulically lock said control device and maintain said outlet valve in said pad-open position.

6. A method according to claim 5, wherein said control sleeve has a second relief duct communicating with said pressure space, said second relief duct closed off by the inner wall of said receiving sleeve in said first retracted position, wherein said step of cancelling the hydraulic locking action of the control device, when the engine camshaft acts on the outlet valve in order to open the outlet valve, includes pushing with said tappet rod said control sleeve by a stroke selected according to a maximum opening stroke of said outlet valve such that said second relief duct is no longer closed off by the inner wall of said receiving sleeve and the pressure fluid is released from said pressure space, thereby causing said drive piston to return into said inner end position in which said thrust transmitting part rests flush at an end face of said control sleeve.

7. A method according to claim 11, further comprising the step of mounting said control device in a bore of a rocker lever positioned at the cylinder head, wherein said control device is comprised of:

a drive piston with a first and a second end, supported in a fluid-tight manner in said bore of said rocker lever so as to be moveable between an outer and an inner end position delimited by limiting abutments and acting with a first end onto a rearward end surface of said outlet valve shank;

a control bushing threaded into said bore and having a pressure space opening toward said drive piston and a fluid supply duct opening into said pressure space for feeding a pressure fluid into said pressure space for hydraulically loading said second end of said drive piston;

a spring positioned in said pressure space for loading said second end of said drive piston;

a feed duct extending within said rocker lever and opening into said fluid supply duct;

a check valve with a spring-loaded closure means for preventing flow of the pressure fluid from said pressure space back into said fluid supply duct;

a relief duct extending from said pressure space through said control bushing to a remote end thereof remote from said pressure space; and a closure abutment for closing off said relief duct at said remote end for building and maintaining fluid pressure within said pressure space during said step of positively maintaining said outlet valve in the part-open position for moving said drive piston with said first end toward said rearward end surface into said outer end position and maintaining said drive piston in said outer end position.

8. A method according to claim 7, further including the step of using said control device as a hydraulic valve play compensation device wherein a play occurring within said outlet valve actuating mechanism is compensated by filling said pressure space with pressure fluid and thereby moving said drive piston in direction toward said outlet valve.

9. A method according to claim 7, wherein during said step of intermediately opening, due to the forces acting within said pressure space, said drive piston moves toward said rearward end surface, following a movement of said outlet valve shank, into said outer end position and said pressure space is filled with pressure fluid such that said drive piston is hydraulically locked in said outer end position so as to secure with said first end said outlet valve shank, when moving toward a closed position of said outlet valve, in said part-open position.

10. A method according to claim 9, further including the step of returning said drive piston from said outer end position into said inner end position by actuating said rocker lever via said camshaft such that said rocker lever is moved away from said closure abutment, said relief duct is opened, and the pressure fluid is released from said pressure space so that said drive piston can return into said inner end position.

* * * * *